US011619087B2

(12) United States Patent
Seppänen et al.

(10) Patent No.: US 11,619,087 B2
(45) Date of Patent: Apr. 4, 2023

(54) HOLD-OPEN ARRESTER ARRANGEMENT HAVING A HOLD-OPEN FUNCTION TO HOLD A DOOR OPEN

(71) Applicant: Abloy Oy, Joensuu (FI)

(72) Inventors: Sauli Seppänen, Joensuu (FI); Juhani Karvonen, Kuopio (FI)

(73) Assignee: ABLOY OY, Joensuu (FI)

( * ) Notice: Subject to any disclaimer, the term of this patent is extended or adjusted under 35 U.S.C. 154(b) by 50 days.

(21) Appl. No.: 17/405,474

(22) Filed: Aug. 18, 2021

(65) Prior Publication Data

US 2022/0090422 A1 Mar. 24, 2022

(30) Foreign Application Priority Data

Sep. 21, 2020 (EP) ..... 20197159.5

(51) Int. Cl.
*E05F 3/22* (2006.01)

(52) U.S. Cl.
CPC ..... *E05F 3/222* (2013.01); *E05F 2003/228* (2013.01); *E05Y 2900/132* (2013.01)

(58) Field of Classification Search
CPC ... E05F 3/22; E05F 3/221; E05F 3/222; E05F 2003/228; E05Y 2900/134; E05Y 2201/236
See application file for complete search history.

(56) References Cited

U.S. PATENT DOCUMENTS 3,905,063 A * 9/1975 Coulter ..... E05F 3/222 340/630
4,286,412 A * 9/1981 Stevens ..... E05F 3/222 292/270
4,506,407 A * 3/1985 Downey ..... E05C 17/28 16/49
4,715,146 A * 12/1987 Atsumi ..... E05F 3/222 16/48.5
4,750,236 A * 6/1988 Teague, Jr. ..... E05C 17/28 292/270
5,448,798 A * 9/1995 Coleman ..... E05F 5/08 292/273
5,511,284 A * 4/1996 Current ..... E05F 3/222 292/201

(Continued)

FOREIGN PATENT DOCUMENTS

DE 3806662 A1 9/1988
DE 102014211549 A1 12/2015
EP 1544394 A2 * 6/2005 ..... E05F 1/006

OTHER PUBLICATIONS

European Search Report issued in corresponding EP application No. 20 19 7159 completed on Mar. 1, 2021 (2 pages).

*Primary Examiner* — Jeffrey O'Brien
(74) *Attorney, Agent, or Firm* — Muncy, Geissler, Olds & Lowe, P.C.

(57) ABSTRACT

The hold-open arrester arrangement has a hold-open arrester arrangement having a hold-open function to hold a door open. The arrangement has also an electric release arrangement. The release arrangement is arranged to release the hold-open function in a fire alarm situation. The hold-open arrester arrangement comprises a sliding block and an arrester unit. The sliding block is connectable with a slide rail in a sliding manner and also pivotable connectable to an arm of a door closer. The arrester unit is connectable to the slide rail and has a body, said electric release arrangement, and said hold-open function with the sliding block.

20 Claims, 4 Drawing Sheets

(56) References Cited

U.S. PATENT DOCUMENTS

Figure 1:
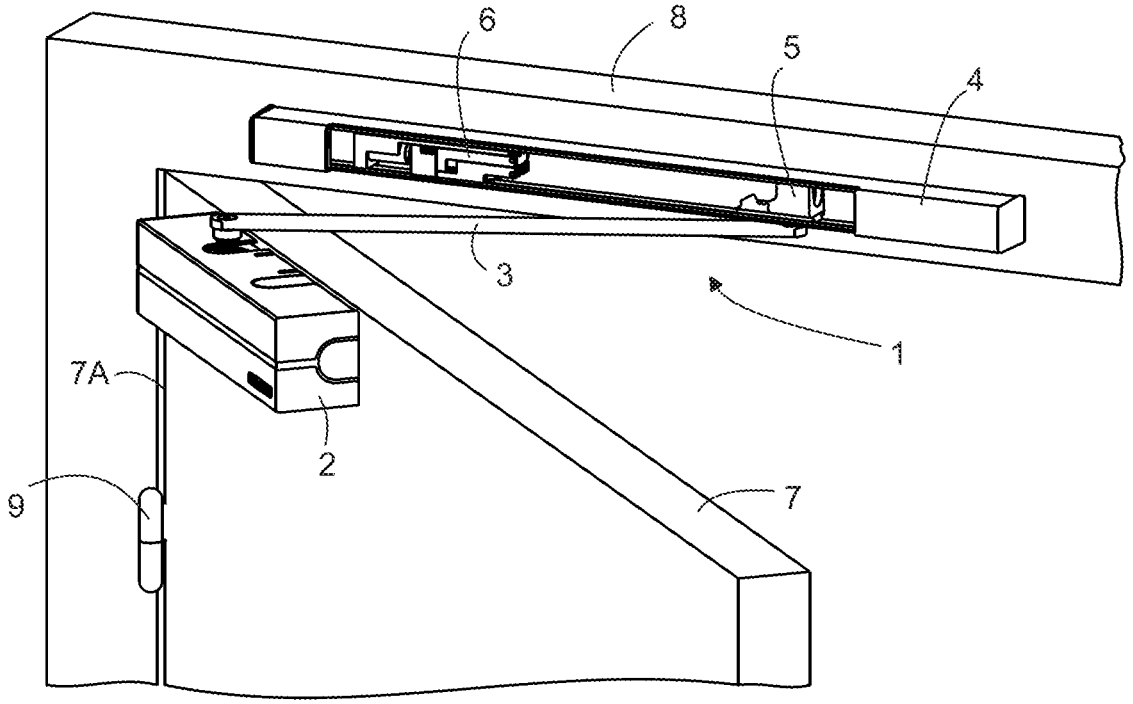

| | | | | |
|---|---|---|---|---|
| 6,253,417 | B1 * | 7/2001 | Rusiana | E05C 17/28 16/85 |
| 8,225,458 | B1 * | 7/2012 | Hoffberg | E05F 15/73 16/84 |
| 10,865,595 | B2 * | 12/2020 | Coleman | E05F 1/10 |
| 11,280,126 | B2 * | 3/2022 | Seppänen | E05F 3/227 |
| 2021/0214982 | A1 * | 7/2021 | Seppänen | E05F 3/227 |
| 2022/0162894 | A1 * | 5/2022 | Seppänen | E05F 3/221 |

* cited by examiner

HOLD-OPEN ARRESTER ARRANGEMENT HAVING A HOLD-OPEN FUNCTION TO HOLD A DOOR OPEN

FIELD OF TECHNOLOGY

The invention relates to a hold-open arrester arrangement having a hold-open function to hold a door open. The hold-open arrester is arranged to be installed to a slide rail, which is in connection with a door closer through an arm of the door closer and a sliding block. Especially, the invention relates to a hold-open arrester having also an electric release arrangement. The release arrangement is arranged to release the hold-open function in a fire alarm situation

PRIOR ART

Hold-open arresters are devices, which are used with door closers to hold doors open. Doors may be desired to keep open on daytime in hospitals, schools, libraries etc. The hold-open arrester is installed to a slide rail in a fixed manner. The hold-open arrester is in connection with a door closer through an arm of the door closer and a sliding block. When opening the door, the sliding block moves along the slide rail until it meets the hold-open arrester. The attachment between the sliding block and the hold-open arrester is made. Therefore, the sliding block cannot slide back due to the force of the door closer, and the door is hold open.

In fire situations doors should be closed in order to prevent propagation of the fire. Therefore, there are hold-open arresters having an electric release arrangement. The electric release arrangement is arranged to release the hold-open function in a fire alarm situation. When the hold-open function is released the sliding block can move back to a position where the door is closed, and therefore the door is closed when the fire situation is detected.

Although, the known solutions work as designed they can be still improved, like power consumption and lifetime of a possible battery with the hold-open arrester.

SHORT DESCRIPTION

The object of the invention is to provide an alternative hold-open arrester arrangement. The object is achieved in a way described in the independent claim. Dependent claims illustrate different embodiments of the invention. The inventive arrangement has a low power consumption, and therefore a battery lifetime is long in the embodiments of the invention utilizing the battery.

An embodiment according to the invention has a hold-open arrester arrangement having a hold-open function to hold a door open. The arrangement has also an electric release arrangement. The release arrangement is arranged to release the hold-open function in a fire alarm situation. The hold-open arrester arrangement comprises a sliding block 5 and an arrester unit 6. The sliding block 5 is connectable with a slide rail 4 in a sliding manner and also pivotable connectable to an arm 3 of a door closer. The arrester unit 6 is connectable to the slide rail 4 and has a body 6B, said electric release arrangement, and said hold-open function with the sliding block 5.

The sliding block 5 comprises a push surface 11A and a hook 11, and the arrester unit 6 has a front end 6C being arranged to receive the hook 11. The arrester unit has also a slide element 14 being spring-biased towards an arresting position of the slide element 14 at the front end 6D of the arresting unit 6. The arresting unit further comprises a circled detent 19. The slide element 14 at the arresting position is arranged to keep the circled detent 19 at a holding location.

The arrester unit 6 has also a lever 12 being pivotable attached to the slide element 14. The lever has an arm 12A with a free end 12C and a projection 12B. The lever is spring-biased so that the free end 12C is arranged to contact the push surface 11A when arrester unit 6 is receiving the hook 11. When receiving the hook 11 the slide element 14 is arranged to move towards a rear end of the arrester unit 6 by a pushing force from the sliding block 5 via the lever 12 until the projection 12B is turned due to a stop surface 6C of the body 6B. Said moving of the slide element 14 towards the rear end releases the circled detent 19 from the holding location allowing the hook 11 move further towards the rear end.

When said lever 12 turns due to the stop surface 6C the arm 12A, it is arranged to turn out of the way of the push surface 11A of the sliding block 5, whereby the hook 11 can further move towards the rear end of the arrester unit 6, and the slide element 14 moves to the arresting position due to the spring-biasing force. This movement of the slide element guides the circled detent 19 to the holding location, whereby the sliding block 5 is kept in connection with the arrester unit 6 providing said hold-open function. It is worth to mention that the free end 12C of the lever and/or the a part of the push surface 11A (an edge area of the push surface) can be designed so that it improves the turning of the lever.

The electric release arrangement is arranged to move the slide element 14 towards the rear end in case of fire alarm whereby releasing the circled detent 19 from the holding location allowing the sliding block 5 to move away from the arrester unit 6.

The front end of the arrester unit 6 further comprises a pivotable part 32 having a basic position being kept by a holding spring 28 via a connection arm 31. The pivotable part 32 at the basic position is arranged to keep the circled detent 19 at the holding location. In case a pulling force from the sliding block is greater than a threshold force value, the holding spring, the connection arm and the pivotable part are arranged to release the circled detent 19 from the holding location thereby allowing the movement of the sliding block 5 away from the arrester unit 6. The threshold force value depends on the holding spring.

LIST OF FIGURES

Figure 2:
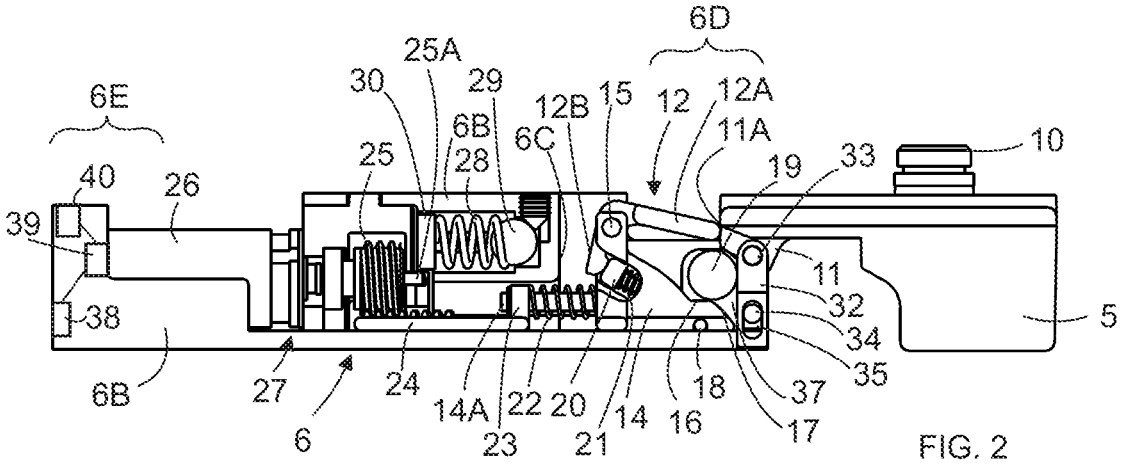
Figure 3:
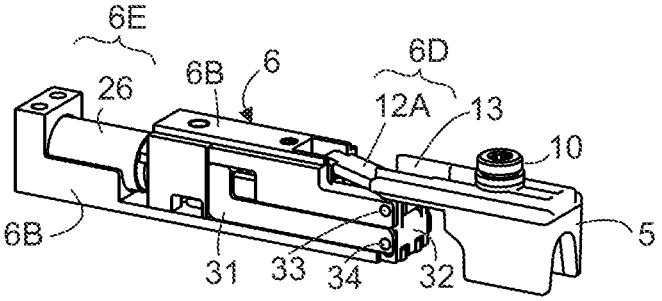
Figure 4:
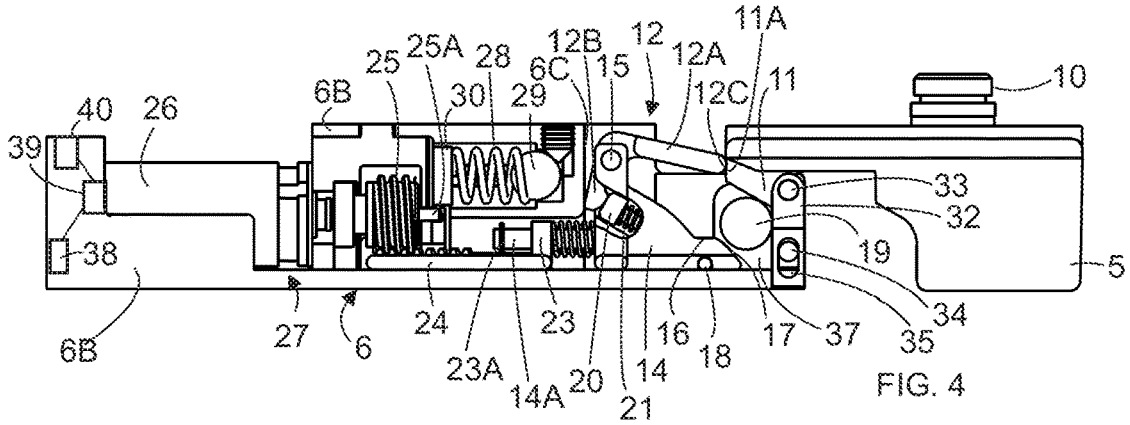
Figure 5:
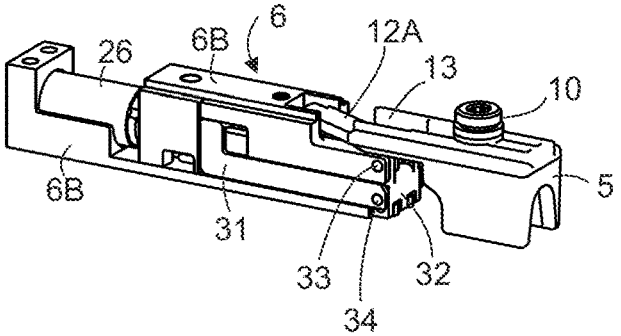
Figure 6:
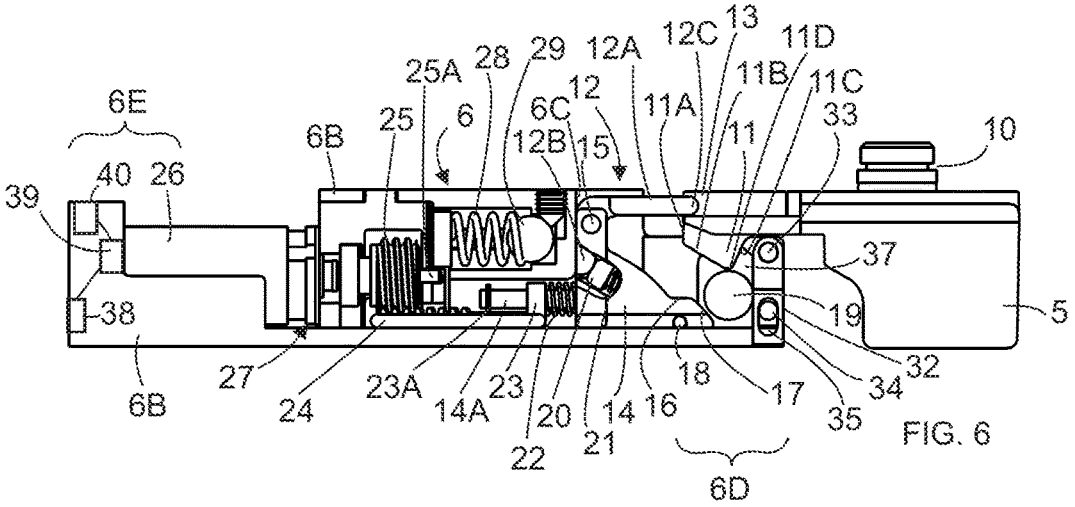
Figure 7:
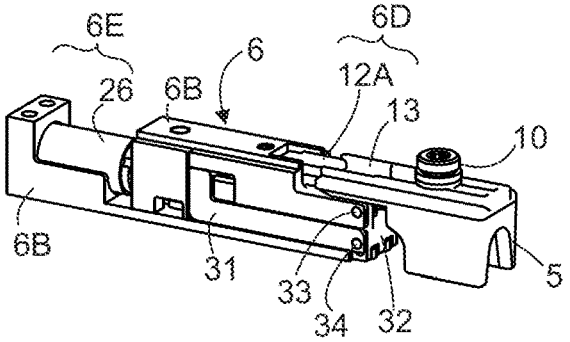
Figure 8:
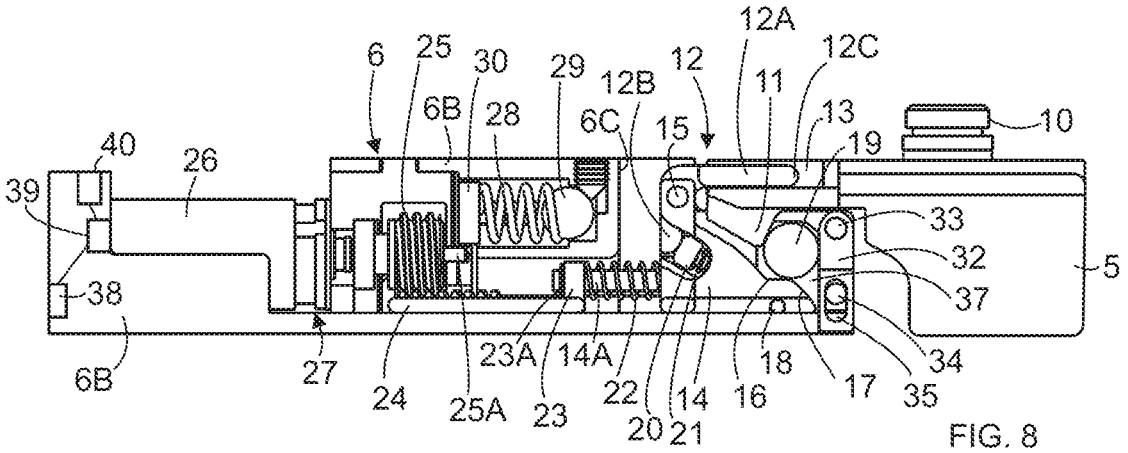
Figure 9:
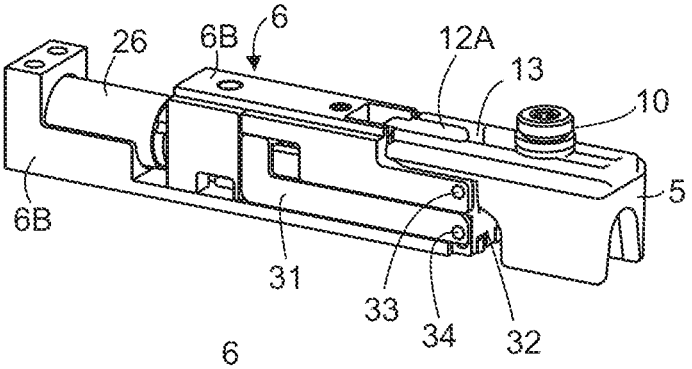
Figure 10:
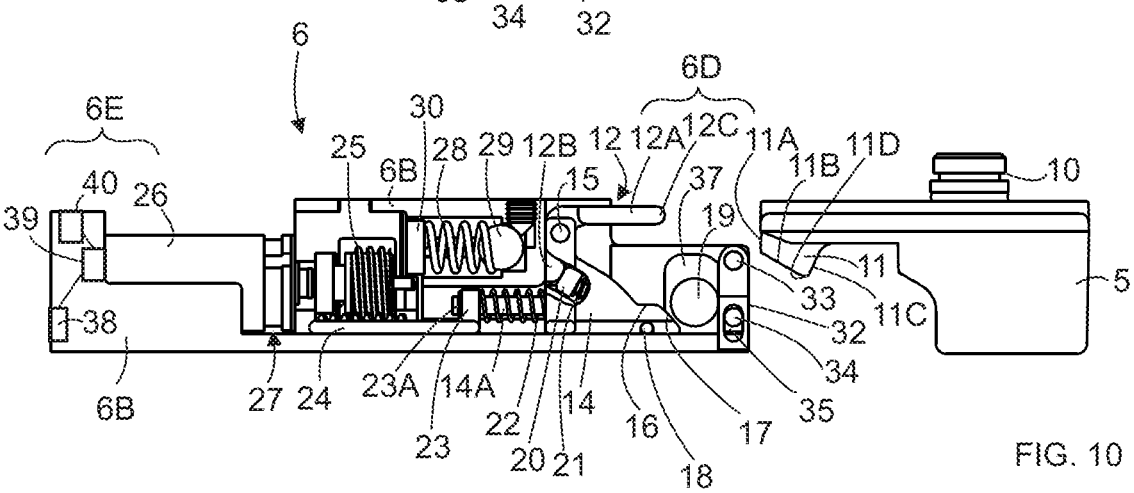
Figure 11:
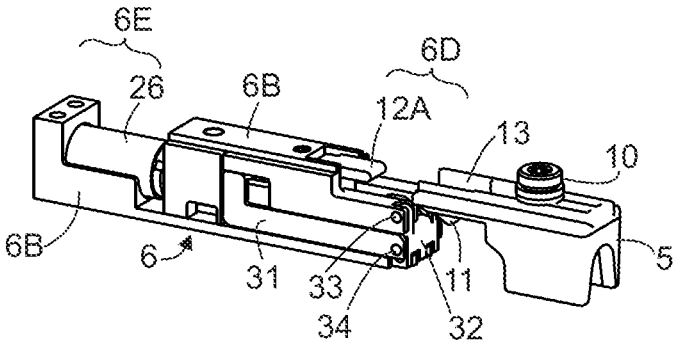
Figure 12:
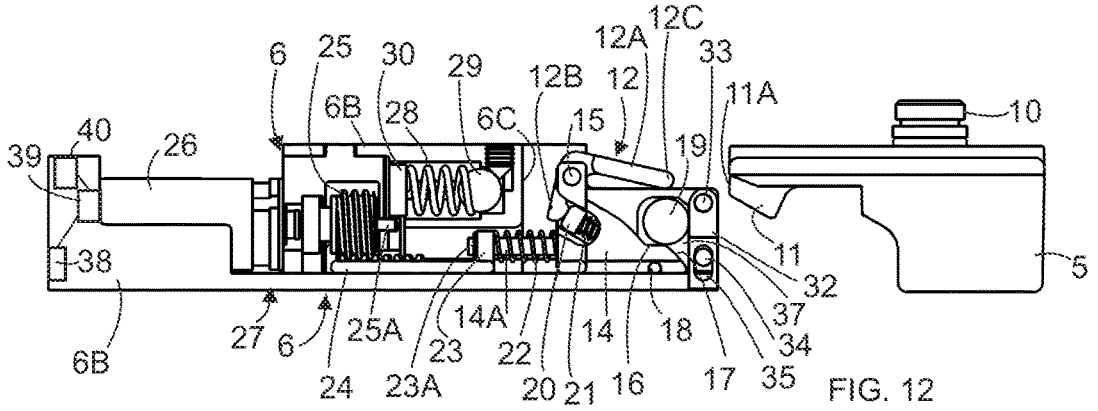
Figure 13:
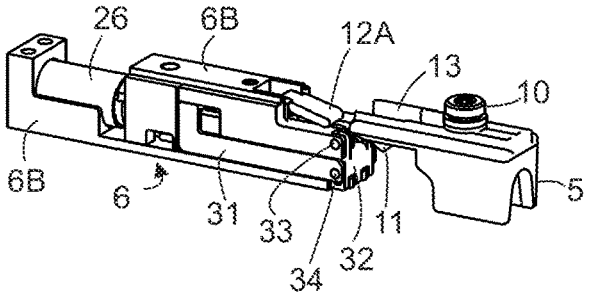
Figure 14:
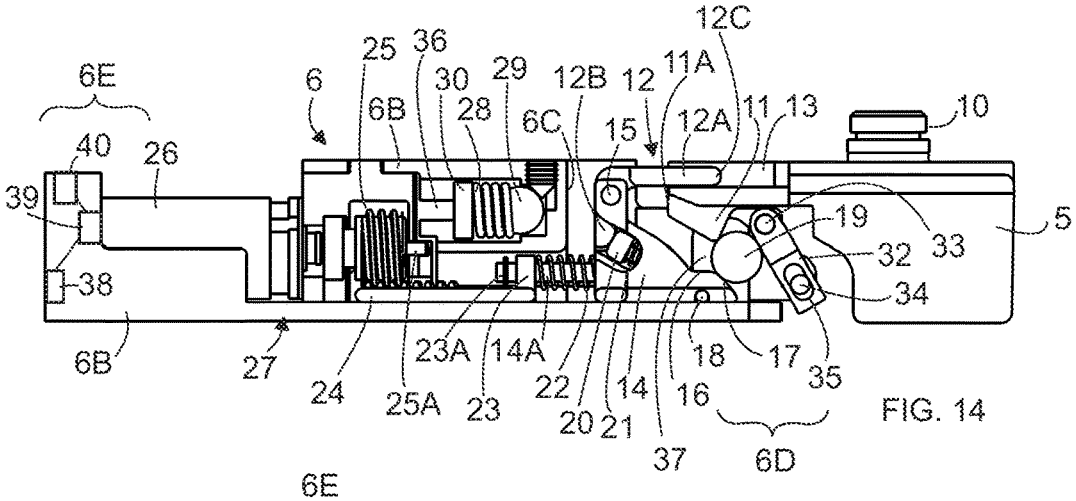
Figure 15:
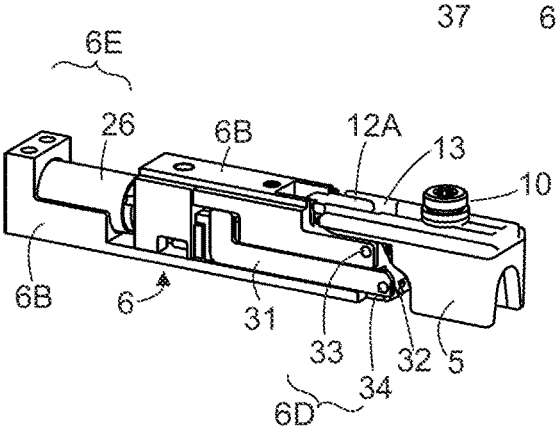

In the following, the invention is described in more detail by reference to the enclosed drawings, where FIG. 1 illustrates an example of a hold-open arrester arrangement according to the invention when installed on a door, FIG. 2 illustrates an embodiment of the hold-open arrester arrangement according to the invention when an arrester unit is just receiving a sliding block, FIG. 3 illustrates another view of the situation of FIG. 2, FIG. 4 illustrates the hold-open arrester arrangement according to the invention when the arrester unit is receiving the sliding block, and a slide element is moving towards the rear end of the arrester unit, FIG. 5 illustrates another view of the situation of FIG. 4, FIG. 6 illustrates the hold-open arrester arrangement according to the invention when a pivotable lever has turned out of the way of the sliding block, FIG. 7 illustrates another view of the situation of FIG. 6, FIG. 8 illustrates the hold-open arrester arrangement according to the invention when the sliding block is hold within the arrester unit, FIG. 9 illustrates another view of the situation of FIG. 8, FIG. 10 illustrates the hold-open arrester arrangement according to the invention where the hold-open function is released and the sliding block is moving away from the arrester unit, FIG. 11 illustrates another view of the situation of FIG. 10, FIG. 12 illustrates the hold-open arrester arrangement according to the invention where the hold-open function is released, the sliding block is moving away from the arrester unit, and slide element has moved to an arresting position, FIG. 13 illustrates another view of the situation of FIG. 12, FIG. 14 illustrates the hold-open arrester arrangement according to the invention where a pulling force from the sliding block is moving a pivotable part, and FIG. 15 illustrates another view of the situation of FIG. 14.

DESCRIPTION OF THE INVENTION

FIG. 1 illustrates an example of a hold-open arrester arrangement according to the invention when installed on a door. The installation 1 comprises a door closer 2, an arm 3 of a door closer and a slide rail 4. In this example the door closer has been installed on the door 7. The slide rail has been installed on a door frame 8. The door has been attached to the frame via the hinges 9. The slide rail has a sliding block 5 that is arranged to move in a sliding manner along the rail. The sliding block is also pivotable connected to the arm 3 of the door closer.

An arrester unit 6 has also been installed in the slide rail 4 in a fixed manner. It provides a hold-open function in order to hold the door open. When the door 7 is opened from the closed position, the door closer 2 tensions for closing the door after the opening. At the same time the arm 3 pivots, and the sliding block 5 moves along the slide rail 4 towards the arrester unit 6 and the hinge side 7A of the door. When the door has been opened so that the sliding block 5 hits the arrester unit 6, the attachment is formed between the sliding block 5 and the arrester unit 6 in order to hold the door open.

So, an example of the inventive embodiment has a hold-open arrester arrangement having a hold-open function to hold a door open. The arrangement has also an electric release arrangement, which is arranged to release the hold-open function in a fire alarm situation. The arrangement comprises also a sliding block 5 and an arrester unit 6. The sliding block 5 is connectable with a slide rail 4 in a sliding manner and also pivotable connectable to an arm 3 of a door closer. The arrester unit 6 is also connectable to the slide rail 4 and it has a body 6B, the electric release arrangement, and said hold-open function with the sliding block 5.

FIGS. 2-15 show embodiments of the arrester unit 6 and the sliding block 5 according to the invention in more detail. Some features are illustrated quite schematically. The sliding block 5 comprises a push surface 11A, and a hook 11. The arrester unit 6 has a front end 6D being arranged to receive the hook 11. The slide element 14 is spring-biased towards an arresting position of the slide element 14 at the front end 6D of the arresting unit 6. FIG. 2 shows the slide element at the arresting position. The arresting unit further comprises a circled detent 19. The slide element 14 at the arresting position is arranged to keep the circled detent 19 at a holding location. The holding location is illustrated in FIG. 2 and in FIGS. 8 and 12 as well.

The arrester unit 6 has also a lever 12, which is pivotable attached to the slide element 14, the lever having an arm 12A with a free end 12C and a projection 12B. An axle stub 15 can be used for attaching the lever with the arm. The lever is spring-biased so that the free end 12C is arranged to contact the push surface 11A when arrester unit 6 is receiving the hook 11. FIG. 2 shows this situation. FIG. 3 shows the same situation from a different view. When receiving the hook 11 the slide element 14 is arranged to move towards a rear end 6E of the arrester unit 6 by a pushing force from the sliding block 5 via the lever 12 until the projection 12B is turned due to a stop surface 6C of the body 6B. The pushing force occurs when the door 7 is opened, and the sliding block 6 moves along the slide rail 4 towards the hinge side 7A of the door. This said moving of the slide element 14 towards the rear end 6E of the arrester unit 6 releases the circled detent 19 from the holding location allowing the hook 11 to move further towards the rear end. FIGS. 4 and 5 show how the slide element 14 has further moved towards the rear end 6E and the circled detent 19 has been released from the holding location.

When said lever 12 turns due to the stop surface 6C the arm 12A is arranged to turn out of the way of the push surface 11A, whereby the hook 11 can further move towards the rear end of the arrester unit 6. FIGS. 6 and 7 illustrates this. Since lever 12 does not form a hindrance for the movement of the slide element due to said spring-biasing, i.e. the lever 12 is at the position of FIG. 6/FIG. 8, the slide element 14 can move to the arresting position guiding the circled detent 19 to the holding location, whereby the sliding block 5 is kept in connection with the arrester unit 6 providing said hold-open function. FIG. 8 shows the arresting position of the slide element and the holding location of the circled detent 19. FIG. 9 shows the same situation as FIG. 8 from another view.

The electric release arrangement is arranged to move the slide element 14 towards the rear end 6E in case of fire alarm. This movement of the slide element releases the circled detent 19 from the holding location allowing the sliding block 5 to move away from the arrester unit 6. The embodiment of the invention illustrated in the figures has the electric release arrangement comprising an electric drive 26 and a force transmitting mechanism 23, 24, 25 between the electric drive 26 and the slide element 14. The fire alarm can be detected from a fire alarm interface 38. The fire alarm interface provides fire alarm. The fire alarm interface can be a sensor or a connection to an external fire alarm arrangement. The arrester unit has a circuit board or the like 39, which is connected to the fire alarm interface 38 and arranged to control the electric drive 26 so that in case of fire alarm the electric drive moves the slide element 14 towards the rear end. FIGS. 10 and 11 show how the electric release arrangement has moved the slide element towards the rear end 6E, the circled detent has released from the holding location, and the sliding block 5 has moved away from the arrester unit 6. This movement of the sliding block can be achieved by the door closer.

The inventive hold-open arrester arrangement comprises also a pivotable part 32 having a basic position being kept by a holding spring 28 via a connection arm 31. The pivotable part 32 is at the front end of the arrester unit 6. The pivotable part 32 at the basic position is arranged to keep the circled detent 19 at the holding location. The basic position of the pivotable part 32 can be seen in FIGS. 2, 4, 6, 8 10, and 12, for example. The holding spring 28 can be situated to any suitable place in the arrester unit. As said the connection arm 31 connects the holding spring and the pivotable part.

The holding spring, the connection arm and the pivotable part are arranged to release the circled detent 19 from the holding location thereby allowing the movement of the sliding block 5 away from the arrester unit 6 in case a pulling force from the sliding block is greater than a threshold force value. FIGS. 14 and 15 show this situation. The threshold value force depends on the holding spring 28. More precisely, mechanism may also affect little to the threshold value, so mainly the threshold force value depends on the holding spring, whose tension can be adjusted. As can be noticed the door kept open by the arrester unit 6 can be closed by pushing or pulling the door strongly enough in order to achieve the threshold force level. Therefore, the pivotable part 32 connected with the holding spring 28 prevent breaking of the arrester unit and/or the sliding block in case of external force, which overloads the structures of the invention.

When the hold-open function has been released by said electric release arrangement due to the fire alarm, i.e. fire situation. The arrester unit does not hold the door open, and the door closer turns the door to be closed. The door can still be opened by people who escape out because of the fire. The sliding block 5 does not grip with arrester unit 6 due to these door openings, so door closer turns the door to the closed position. The slide element 14 is kept at the position illustrated in figures, 10 and 11 after the fire alarm, so therefore during the fire situation. After the end of fire situation, the electric release arrangement is arranged to create electrically a starting movement of the slide element 14 in order to move the slide element 14 to the arresting position by said spring-biasing. When the slide element has moved the arresting position, the inventive arrangement works as described above.

After the fire alarm when the slide element 14 has moved away from the arresting position, the slide element is kept away the arresting position. This function is achieved by a self-locking feature of the electric release arrangement. The self-locking feature is released by said starting movement of the slide element, which is created electrically.

The end of the fire situation can be detected via the fire alarm interface 38. A signal indicating the end of the fire situation is received through the fire alarm interface 38, and as response to this signal the electric release arrangement is arranged to create electrically the starting movement of the slide element 14. The starting movement is enough strong to release the self-locking feature. After the self-locking has been released the spring-biasing moves the slide element to the arresting position.

The embodiment showed in the figures has the electric release arrangement comprises an electric drive 26 and a force transmitting mechanism 23, 24, 25, between the electric drive 26 and the slide element 14. The electric drive 26 can be an electric motor or a solenoid. The electric motor could be more convenient in many embodiments but the selection between the motor or the solenoid depends on many factors like costs, manufacturing reasons etc. The force transmitting mechanism can comprise a spring support part 23, a toothed bar 24, and worm gear 25, as in the embodiment of the figures. The spring support part 23 is attached to the toothed bar 24, and slideable connected with the slide element 14. The worm gear is in force transmitting connection to the toothed bar and the electric drive 26. The force transmitting connection between the worm gear and the electric drive 26 is direct or through a gear arrangement 27. In the direct connection the axis of the electric drive can be directly connected to the worm gear. If the gear arrangement 27 is used the axis of the electric drive is connected to the gear arrangement and another axis 25A connects the gear arrangement and the worm gear. The worm gear forms the self-locking feature with the toothed bar. It may also be possible that in embodiments using the gear arrangement 47, the gear arrangement forms the self-locking feature. The toothed bar 24 and the spring support part 23 fixed to the bar are arranged to be moveable in the body 6B, in a slideable manner.

The electric release arrangement can be constructed in many ways. For example, in a case where the electric drive is the solenoid having a plunger, the force transmitting mechanism may comprise a bar arrangement between the plunger and the slide element 14. The self-locking feature can be achieved by the gear arrangement or a bent axle, for example.

The hold-open arrester arrangement according to the invention comprises a power source 40 for the electric drive. The power source can be a battery or power interface for external power. The battery can be situated inside the arrester unit 6 or outside it, like in the slide rail 4. The external power source can be an electric power network.

Power for the electric drive, like the motor or the solenoid, is controlled by the circuit board comprising suitable switching functions and switches. As said the power source can be the battery or the electric power network for example. When the fire alarm is detected by a fire alarm interface 38, the circuit board or the like (integrated circuit board etc.) as response to the detection of the fire alarm provides power to the electric drive 26. The power to the electric drive controlled by the circuit board can be a relatively short power pulse, which is enough to move slide element 14 against the spring-biasing force. When the fire situation is ended it can be detected by the fire alarm interface 38 as well or by another interface. So, the inventive arrangement may have several interfaces for receiving different signals. As response of the detection of the end of the fire situation, the circuit board or the like can provide power to the electric drive in order to create electrically said starting movement of the slide element 14. This power for the starting movement can also be a relatively short power pulse.

As can be noted, the inventive arrangement is very power efficient since only short (in time) energy pulses is required with fire alarm situations and when setting the arrangement to a normal operation after the end of the fire situations. The normal operation occurs when there is no fire alarm/fire situation. During the normal operation when holding the door open, electric power is not used.

Although the door can be moved by pushing or pulling, the pushing force said in this text means the force which moves the sliding block 5 towards the arrester unit 6, in other words, the arrester unit is pushed by the force from the sliding block. The door is moved to be open. Correspondingly, the pulling force said in this text means the force which moves the sliding block 5 away from the arrester unit 6, in other words, the arrester unit experiences a pulling force from the sliding block. The door is moved to be closed.

It can be seen in the figures that arrester unit 6 comprises space 37 for the circled detent 19 to be at the holding location or away from the holding location. The slide element 14 has a slope 17 for guiding the circled detent 19 to the holding location and away from the holding location. The circled detent 19 is a ball or a roll. The hook comprises a front slope 11B, a rear slope 11C and a tip 11D between the front and rear slopes. The front slope 11B forms a further surface for guiding the circled detent 19 away from the holding location, and the rear slope 11C forming an arresting surface, which is against the circled detent 19, and therefore the sliding block 5 is kept in connection with the arrester unit 6.

In addition, the slide element can further comprise a holding surface 16 next to the slope 17. The holding surface is arranged to hold the circled detent 19 at the holding location, in this embodiment, but it should be noted that the slope 17 for guiding the circled detent can be arranged to hold the circled detent at the holding location.

In addition, it is also possible that the inventive arrangement comprises a sliding piece 18 between the slide element 14 and the body 6B. There can also be more than one sliding piece. The sliding piece 18 can be a ball or a roll. The sliding piece provides an easier movement of the slide element, and it is situated near the slope 17 and/or the possible holding surface 16 next to the slope 17. In this way the energy needed to move to slide element can be relatively minor when the fire alarm occurs or when the fire situation has been ended.

In order to have said spring-biasing of the slide element, the inventive embodiment comprises a bias spring 22, and the slide element 14 comprises a rod 14A. The rod is in a slideable connection with the attachment part 23A being fixed to the body 6B. The attachment part forms a support for the rod and also restricts the movement of the slide element 14. The bias spring 22 provides said spring-biasing of the slide element 14 towards the arresting position. The bias spring is between the main body of the slide element 14 and a spring support part 23. So, the tension of the spring occurs between the slide element 14 and the spring support part 23. The spring support part 23 is fixed to the toothed bar 24. The bias spring is on the rod 14A in the embodiment of the figures. As illustrated in the figures, the rod 14A may be moveable via a hole on the spring support part 23, and a hole on the attachment part 23A.

The slide element can have another spring 21, which provides said spring-biasing of the lever 12. The embodiment of the figures shows a possible structure where the other spring 21 pushes a piece 20, which in turn is against the projection 12B of the lever 12. The structure of the other spring 21 in the examples of the figures can also provide a part of said spring-biasing of the slide element 14 towards the arresting position. So, the spring-biasing of the slide element is formed by the bias spring 22 and the other spring 21. It is worth to note that a convenient way is that the bias spring 22 mainly provides the spring-biasing of the slide element 14. However, it is also possible that the other spring 21 is constructed/implemented in such a way that it does not provide spring-biasing for the slide element 14.

The sliding block 5 can also comprise a groove 13 for the lever 12. The groove receives the lever when it has been turned out of way of the sliding block and the sliding block is moving towards the rear end 6E of the arrester unit 6. The sliding block may also have a connection projection 10 for the arm 3 of the door closer.

The pivotable part 32 forms a wall structure. The wall structure can, for example, be a plate piece or a grill, which prevents, together with the holding spring 28 and the connection arm 31, the circled detent 19 to move away from the holding location. The pivotable part is pivotable connected to the body 6B via an axle stub 33. The arm 31 is connected to the pivotable part via another axle stub 34. The pivotable part 32 has a longitudinal hole 35 for the other axle stub 34.

The arm 31 can have any suitable form. The location of the holding spring 28 affects to the form of the arm 31. The embodiment of the figures has an L-shape arm 31. In addition, the inventive arrangement may have an adjustment screw 41. The tension of the holding spring 28 can be adjusted by the adjustment screw 41. The embodiment of the figures utilizes a ball 29 between the holding spring 29 and the adjustment screw. However, other structures are also possible to use with the adjustment screw. By adjusting the tension of holding spring 28, the threshold force value can be set to a value, which is designed to be used. The arm 31 comprises or is connected to a part 30 is against the holding spring. The part 30 moves with the arm 31 towards the holding spring when the pivotable part 32 turns due to the strong external pulling force as illustrated in FIG. 14. The body 6B may have a guiding slot 36 for the movement of the arm 3 and the part 30. There can also be another arm 3 on the other side of the arrester unit, i.e. on the side not seen from the figures.

The invention can be used with fire doors and also any other doors for preventing expansion of fire. The fire doors have been specifically designed to prevent expansion of fire. When fire alarm occurs the door/fire door can be closed automatically as described above. When there is no fire alarm it is possible to keep the door open. As said the power for the functions in case of the fire alarm or after the end of the fire for achieving back the hold-open function of the inventive arrangement, is supplied by external power supply, a supercapasitor or the battery, or a combination of these means. The battery can be rechargeable. The inventive arrangement can also be arranged so that in a power break down situation where voltage drops, the hold-open function is released, so the door is closed automatically. Further in cases of communication fails (for example with a fire alarm system or a security system) too long communication access time can cause the hold-open function to be released, and therefore closing the door automatically.

FIG. 1 shows the installation where the door closer has been installed on the door 7. and the slide rail on a door frame 8, but the installation can be opposite as well. The inventive arrangement can also be retrofitted to existing door closer arrangements. The inventive arrester unit 6 can be installed on an existing slide rail 4, and the inventive sliding can be connected to existing slide rail 4 and the existing arm 3 of the door closer.

As can be noted the invention can be made in many different ways, It is evident from the above that the invention is not limited to the embodiments described in this text but can be implemented in many other different embodiments within the scope of the independent claim.

The invention claimed is:

1. A hold-open arrester arrangement for a door closer with an arm and slide rail, the arrangement comprising a sliding block and an arrester unit, the sliding block being connectable with the slide rail in a sliding manner and also pivotable connectable to the arm, the arrester unit being connectable to the slide rail and having a body, an electric release arrangement, and a hold-open function with the sliding block, the sliding block comprising a push surface, and a hook, and the arrester unit having a front end being arranged to receive the hook, and a slide element being spring-biased towards an arresting position of the slide element at the front end of the arrester unit, the arrester unit further comprising a circled detent, the slide element at the arresting position being arranged to keep the circled detent at a holding location, the arrester unit having a lever being pivotable attached to the slide element, the lever having an arm with a free end and a projection, the lever being spring-biased so that the free end is arranged to contact the push surface when the arrester unit is receiving the hook, and when receiving the hook the slide element is arranged to move towards a rear end of the arrester unit by a pushing force from the sliding block via the lever until the projection is turned due to a stop surface of the body, said moving of the slide element towards the rear end releasing the circled detent from the holding location allowing the hook to move further towards the rear end, when said lever turns due to the stop surface, the arm is arranged to turn out of the way of the push surface, whereby the hook is configured to further move towards the rear end of the arrester unit, and the slide element moves to the arresting position guiding the circled detent to the holding location, whereby the sliding block is kept in connection with the arrester unit providing said hold-open function, the electric release arrangement being arranged to move the slide element towards the rear end in case of fire alarm whereby releasing the circled detent from the holding location allows the sliding block to move away from the arrester unit, the front end of the arrester unit further comprising a pivotable part having a basic position being kept by a holding spring via a connection arm, the pivotable part at the basic position being arranged to keep the circled detent at the holding location, and the holding spring, the connection arm and the pivotable part being arranged to release the circled detent from the holding location thereby allowing the movement of the sliding block away from the arrester unit in case a pulling force from the sliding block is greater than a threshold force value, which is depending on the holding spring.

2. The hold-open arrester arrangement according to claim 1, wherein the electric release arrangement is arranged to create electrically a starting movement of the slide element after an end of fire situation in order to move the slide element to the arresting position by said spring-biasing.

3. The hold-open arrester arrangement according to claim 2, wherein the slide element has a slope for guiding the circled detent to the holding location and away from the holding location.

4. The hold-open arrester arrangement according to claim 3, wherein the circled detent is a ball or a roll.

5. The hold-open arrester arrangement according to claim 3, wherein the electric release arrangement comprises an electric drive and a force transmitting mechanism between the electric drive and the slide element.

6. The hold-open arrester arrangement according to claim 5, further comprising a fire alarm interface in order to provide fire alarm and a circuit board, which is connected to the fire alarm interface and arranged to control the electric drive so that in case of fire alarm the electric drive moves the slide element towards the rear end.

7. The hold-open arrester arrangement according to claim 6, wherein the electric drive is an electric motor or a solenoid.

8. A hold-open arrester arrangement according to claim 7, further comprising a power source for the electric drive.

9. A hold-open arrester arrangement according to claim 8, wherein power source is a battery or power interface for external power.

10. The hold-open arrester arrangement according to claim 6, wherein the fire alarm interface is a sensor or a connection to an external fire alarm arrangement.

11. The hold-open arrester arrangement according to claim 5, wherein the force transmitting mechanism comprises a spring support part, a toothed bar, and worm gear, the spring support part being attached to the slide element and the toothed bar, the worm gear being in force transmitting connection to the toothed bar and the electric drive.

12. A hold-open arrester arrangement according to claim 11, wherein the force transmitting connection between the worm gear and the electric drive is direct or through a gear arrangement.

13. The hold-open arrester arrangement according to claim 7, wherein the electric drive is the solenoid having a plunger, and the force transmitting mechanism comprises a bar arrangement between the plunger and the slide element.

14. The hold-open arrester arrangement according to claim 2, wherein the pivotable part forms a wall structure.

15. The hold-open arrester arrangement according to claim 3, wherein the hook comprises a front slope, a rear slope and a tip between the front and rear slopes, the front slope forming a further surface for guiding the circled detent away from the holding location, and the rear slope forming an arresting surface, which is against the circled detent meanwhile the sliding block is kept in connection with the arrester unit.

16. The hold-open arrester arrangement according to claim 15, wherein the slide element further comprises a holding surface next to the slide element slope, the holding surface being arranged to hold the circled detent at the holding location.

17. The hold-open arrester arrangement according to claim 2, further comprising at least one sliding piece between the slide element and the body.

18. The hold-open arrester arrangement according to claim 11, wherein the arrangement comprises a bias spring, and the slide element comprises a rod, the rod being in connection with the spring support part, which forms a support to the bias spring, which provides said spring-biasing of the slide element towards the arresting position.

19. The hold-open arrester arrangement according to claim 18, wherein the slide element comprises a second spring, which provides said spring-biasing of the lever.

20. The hold-open arrester arrangement according to claim 19, wherein the second spring is also arranged to provide a part of said spring-biasing of the slide element.

* * * * *